US005089119A

United States Patent [19]

Day et al.

[11] Patent Number: 5,089,119

[45] Date of Patent: Feb. 18, 1992

[54] FILTER FOR A VAPOR COMPRESSION CYCLE DEVICE

[75] Inventors: James Day; Arnold Factor, both of Scotia; Charles E. Baumgartner, Niskayuna, all of N.Y.

[73] Assignee: General Electric Company, Schenectady, N.Y.

[21] Appl. No.: 419,556

[22] Filed: Oct. 10, 1989

[51] Int. Cl.[5] ..... B01D 39/14; B01D 35/02

[52] U.S. Cl. ..... 210/167; 210/196; 210/209; 210/349; 210/497.01; 210/502.1; 210/DIG. 6; 210/DIG. 7; 55/29; 55/75; 55/389; 62/85; 62/474

[58] Field of Search ..... 210/DIG. 6, DIG. 7, 210/167, 196, 288, 349, 209, 496, 502.1, 504, 497.01; 55/29, 74, 75, 387, 389; 62/85, 474

[56] References Cited

U.S. PATENT DOCUMENTS

| | | | |
|---|---|---|---|
| 2,557,557 | 6/1951 | Newcum | 210/131 |
| 2,758,719 | 8/1956 | Line | 210/131 |
| 3,025,233 | 3/1962 | Figert . | |
| 3,080,977 | 3/1963 | Jones | 210/232 |
| 3,175,342 | 3/1965 | Balogh | 55/316 |
| 3,407,617 | 10/1968 | Wischmeyer et al. . | |
| 3,572,050 | 3/1971 | Bottum | 62/85 |
| 4,003,215 | 1/1977 | Roach | 62/476 |
| 4,393,661 | 7/1983 | Vakil | 62/504 |
| 4,406,134 | 9/1983 | Vakil | 62/504 |
| 4,710,312 | 12/1987 | Genest | 252/68 |

OTHER PUBLICATIONS

Parker Condensed Catalog-Halocarbon products, No. HP-3, pp. 32-35.

*Primary Examiner*—Peter Hruskoci
*Assistant Examiner*—Robert J. Popovics
*Attorney, Agent, or Firm*—Sudhir G. Deshmukh; James C. Davis, Jr.; William H. Pittman

[57] ABSTRACT

A filter for the lubricating oil and refrigerant within refrigerators, freezers and heat pumps is provided which does not interfere with the cooling cycle. The filter utilizes a housing with an orifice that functions as an outlet and an inlet for the transfer of fluids. The filter withdrawn fluids from a location between the compressor and the condenser when the compressor cycles on and returns the fluids when the compressor cycles off. Preferred embodiments of this invention provide for the release of additives to the fluids from the filter material. Also provided by the invention are vapor compression cycle devices which incorporate such a filter and a method of filtering said fluids.

30 Claims, 4 Drawing Sheets

FILTER FOR A VAPOR COMPRESSION CYCLE DEVICE

This invention is directed to a filter apparatus for vapor compression cycle devices for separating insoluble species and contaminants from the combination of working fluid with lubricant, which preferably can also dispense treatment additives such as wear inhibitors and oil stabilizers into said combination.

Conventional vapor compression cycle devices (hereinafter sometimes "VCCD") such as those used in air conditioners, freezers, heat pumps and refrigerators comprise a compressor, condenser and expansion device for a working fluid. These components are linked in a closed loop to provide for the circulation of the working fluid and are preferably configured to provide for heat exchange between the working fluid and two separate environments.

The working fluid, often referred to as a refrigerant, is a material that can alternately vaporize and condense within a VCCD during operation so as to alternately absorb and radiate heat within each cycle. When the working fluid is in the form of a condensed liquid, it is passed through an expansion device where it is vaporized and absorbs energy in the form of heat (heat of vaporization). The vapor is typically passed through a heat exchanger to provide for the absorption of heat from the surrounding environment. The vaporized working fluid is compressed and circulated by means of the compressor and delivered to a condenser, where the compressed vapor condenses to a hot liquid which is then typically passed through a second heat exchanger. The cycle is then repeated as the working fluid circulates through the system. The cycle may be continuous but is typically interrupted by turning the compression on and off as needed.

The working fluid is preferably a gas under ambient conditions. Chlorofluorocarbons such as dichlorodifluoromethane and monochlorodifluoromethane have traditionally been employed; however, it has been discovered that they have a detrimental effect on the protective ozone layer above the earth and other fluorocarbons, illustrated by 1,1,1,2-tetrafluoroethane, are now being employed in increasing proportions. Ammonia is one example of working fluid which is not a fluorocarbon. Examples of fluorocarbon working fluids are described in U.S. Pat. No. 4,003,215. The discussion of fluorocarbons in U.S. Pat. No. 4,003,215 is incorporated herein by reference.

It has long been recognized that contaminants such as moisture, scale, sludge and other foreign matter within the working fluid can cause progressive deterioration of conventional VCCD's. For example, moisture tends to cause hydrolysis of the fluorocarbons, resulting in the formation of acids which, in turn, corrode the internal parts of the VCCD.

In addition, it is common practice to combine lubricating oils with the working fluid to reduce compressor wear. The combination thus obtained is hereinafter frequently designated "combined fluids". The presence of acid can cause polymers within the lubricating oil to crosslink, thereby forming sludge, a material which is ineffective in reducing compressor wear and reduces the efficiency of the system.

Wear inhibitors are often introduced to the lubricating oils and may also provide stabilization thereof. Such inhibitors include the zinc dillkyldithiophosphates (ZDDP). Other additives may also be introduced to help render any acidic species harmless or to provide other functions.

High energy costs have resulted in an increase in consumer awareness and concern over the energy efficiency of appliances, such as air conditioners, freezers, etc. Efforts to increase the energy efficiency of the VCCD's and provide economical appliances to the consumer have been continuous. Improvements have been obtained in the energy efficiency of VCCD's through (1) modification of the components such as the development of rotary compressors, (2) modification of the VCCD configuration as disclosed by Vakil in U.S. Pat. Nos. 4,406,134 and 4,393,661 and (3) modification of the working fluid. In these energy efficient designs, the working fluid is often exposed to more rigorous conditions, such as higher internal temperatures and shear environments. Therefore, degradation reactions and sludge formation are of greater concern. If sludge formation is significant, a constriction in the VCCD can result, which can be accompanied by a partial (if not total) reduction in the cooling capacity of this system, thus defeating the energy efficiency of the design of the device.

The use of filters to remove sludge, scale and other foreign matter within combined fluids of a VCCD is well known. For example, Figert, U.S. Pat. No. 3,025,233, discloses an in-line filter for removing acids and moisture from the combined fluids of a refrigeration system. Figert discloses that these in-line filters can be manufactured from material such as activated alumina and crystalline zeolites, which are desired for their absorptive capability toward both water and acids. U.S. Pat. No. 3,407,617 discloses the use of an in-line refrigeration filter containing activated charcoal for the purpose of removing dissolved waxes from the combined fluids.

While conventional in-line filters can be effective in removing the moisture, particulates and other undesired species from the combined fluids of energy efficient VCCD's, such in-line filter can also reduce the compressor efficiency due to the pressure drop across the absorbent material within the filter. The present invention provides a filter configuration which will remove impurities and optionally dispense additives so as to reduce compressor wear, without adversely affecting the operation efficiency of a VCCD.

The present invention provides a filter which can separate impurities from the combined fluids of a VCCD. Some embodiments can also dispense beneficial additives within the combined fluids. When installed in a VCCD, the filter does not restrict the flow of the combined fluids which circulate through the system.

The filter comprises a porous material capable of separating impurities from the combined fluids which flow therethrough. Preferably, the porous absorbent material is also capable of releasing or desorbing beneficial additives to the combined fluids. The filter also comprises a housing for the porous absorbent material. This housing has an orifice for the transfer of combined fluids which functions as both an outlet and an inlet. The housing is adapted to accept connection with a means for transferring combined fluids to the orifice from the high pressure side of the VCCD.

Also provided by this invention is a vapor compression cycle device which incorporates a filter of the present invention and a unique method of filtering the combined fluids within a VCCD. In this method, combined fluids are withdrawn from the VCCD when the compressor is operating up to a predetermined maximum. The withdrawn fluid is filtered and returned to the VCCD once the compressor is turned off.

Figure 2:
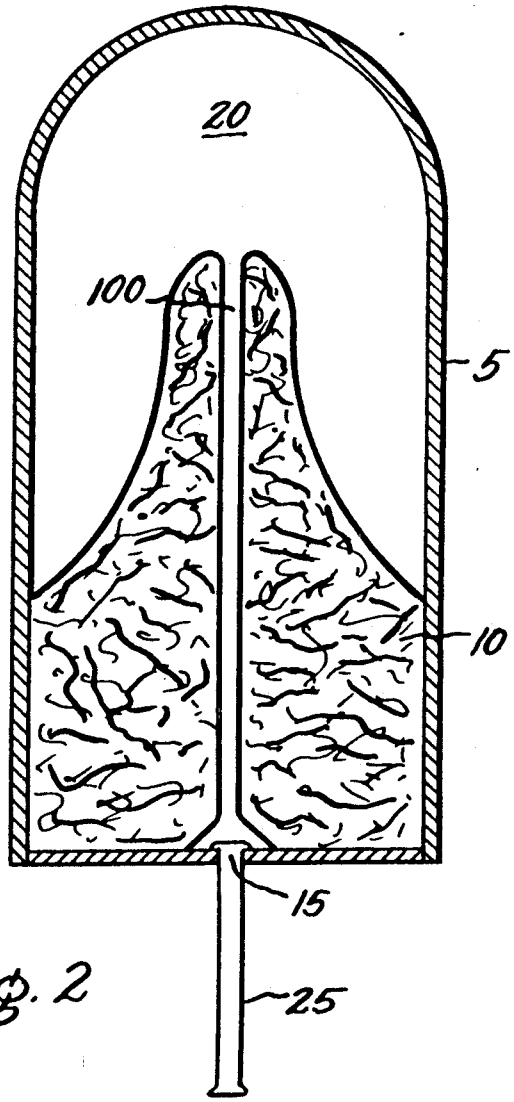
FIGS. 1–4 are schematic representations of filters for a vapor compression cycle device, which are embodiments of this invention.

The various embodiments of the filter of the present invention comprise a housing containing a porous absorbent material capable of separating impurities from the combined fluids. Preferably, the porous absorbent material is capable of separating one or more of the following impurities: moisture, acidic species such as HCl and $FeCl_3$, particulates and oil insoluble species (sludge). Most preferably, the porous absorbent material is also capable of releasing beneficial additives into the combined fluids which flow therethrough.

The housing is adapted to provide an orifice that functions as both an inlet and an outlet for the combined fluids. This can be accomplished by simply positioning the orifice at the lowest point in the housing. When the compressor is turned on, combined fluids will enter the housing and condense therein until the housing is full, forming a mixture of liquid and the aforementioned impurities. After the compressor shuts off, the process reverses itself and working fluid evaporates, reentering the compression cycle with entrained oil; however, the impurities remain trapped in the absorbent material in the housing.

The housing is also adapted to accept connection with a means for transferring combined fluids from the high pressure side of a VCCD to the orifice. The high pressure side of the VCCD is typically that portion between the compressor outlet and the condenser. The compressor itself also provides a region of high pressure. Therefore, the working fluid may be sourced via a line directly from the compressor. Such a utility does not require any specific configuration for the housing; however, the housing must exhibit sufficient structural integrity to withstand the pressure surges in this portion of the VCCD. The high pressure environment in some devices may merit special consideration. Conventional materials used in manufacturing the VCCD should be sufficient for the housing. Conventional seals such as welded joints, soldered joints and threaded joints can be used to provide an adequate connection between the housing and a conduit from the VCCD.

Preferably, the filter housing is adapted to receive combined fluids from a point on the VCCD between the compressor outlet and condensing heat exchanger and most preferably, from the compressor itself or a point within about 30 cm. of the compressor outlet. The compressor and the compressor outlet are regions of highest pressure within the VCCD. Filter connection should be made in this region so that condensation of the working fluids occurs in the housing. It is preferable for the filter to be connected at a low point in the VCCD to provide a trap so that when the system is off, oil will accumulate in the trap. This oil will be forced into the filter by entrainment in the working fluid when the system cycles on.

The housing size has little effect on the operation of the filter but has a significant effect on performance within a VCCD. The empty volume of the housing determines the maximum volume of combined fluids that can be filtered each time the compressor is turned on. Preferably, the housing will fill with combined fluids each time the compressor cycles on. Too large a filter housing will require that the VCCD be supplemented with working fluid to avoid starving the system during operation. Therefore, it is preferable to limit the housing size for reasons of efficiency. The empty volume of the housing is preferably less than 25% of the total volume of the VCCD and, most preferably, less than 10% of the total volume.

The housing may comprise any material that is inert to the combined fluids and the absorbent material and is sufficiently strong to withstand the pressure surges during compressor operation and startup. Metals such as copper and aluminum have been used extensively in VCCD's and are expected to be suitable materials for housings in most systems using fluorocarbon working fluids. Other materials and alloys are expected to be suitable where they are inert to the absorbent material and the working fluid, relative to the components of the VCCD, and they provide adequate barrier properties to the working fluid vapor.

Figure 1:
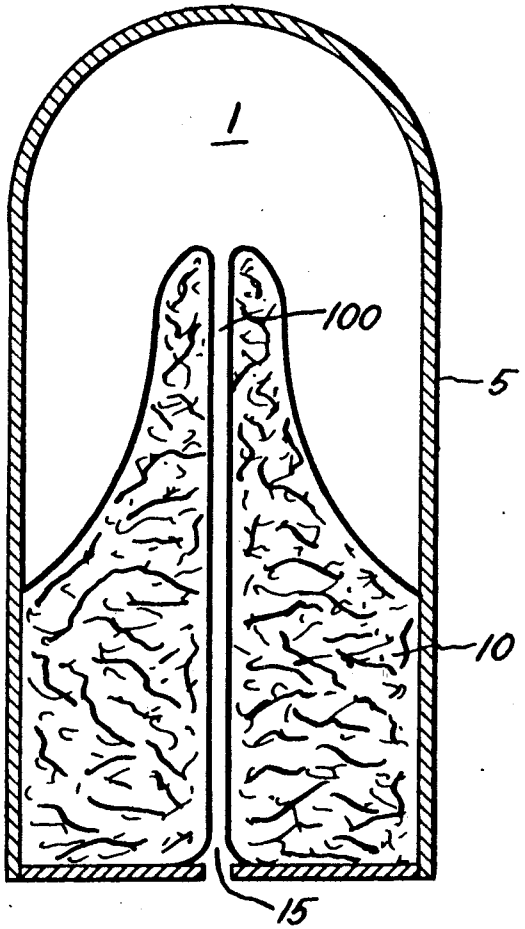
Figure 3:
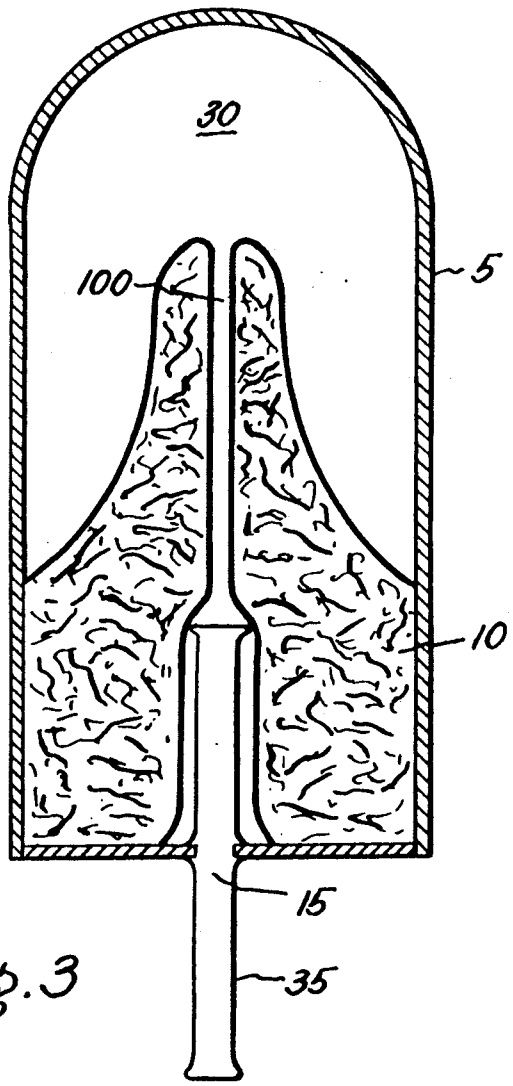

FIG. 1 illustrates a filter of the present invention designated generally by reference numeral 1. The filter shown comprises absorbent material 10 and housing 5 for the absorbent material having an orifice 15 for the transport of combined fluids both into and out of housing 5. FIG. 2 shows an alternative embodiment designated generally by reference numeral 20 wherein tube 25 is positioned within orifice 15 to serve as a connecting means. FIG. 3 shows another embodiment designated generally by reference numeral 30 wherein tube 35 is positioned within orifice 15 to serve as a connecting means and extends within housing 5 to aid in the transport of combined fluids within the housing.

In the embodiments of FIGS. 1–3, the housings are similar in configuration. Each housing has one orifice located opposite the closed end of the housing. This orifice will provide the only outlet and inlet for combined fluids that are transferred in and out of the housing. The configuration of housing 5 shown in FIGS. 1–3 is simple and can easily be constructed in a manner so as to withstand the pressure surges from the delivery of combined fluids within the high pressure side of a VCCD, i.e., from a location between the compressor and the condenser.

Housing 5 of FIGS. 1–3 can be connected to a means for transferring combined fluids from the high pressure side of a VCCD quite simply. For example, housing 5 of FIG. 1 can connect to a conduit for combined fluids by welding or soldering the conduit to housing 5 at orifice 15 or by threading the conduit directly into orifice 15.

FIG. 2 illustrates an alternative means for connecting housing 5 to a conduit wherein tube 25 is connected to orifice 15 at one end and flared at the free end to accept connection with a conduit by means of a receptacle. Such a connecting means allows for removable connection of housing 5 with a VCCD and easy replacement of the filter.

For the embodiment of FIG. 3, tube 35 has a function in addition to providing for easy replacement of the filter. Where orifice 15 is at the lowest point of the housing, tube 35 permits a pool of liquid to reside at the bottom of housing 5 up to the highest point of tube 35.

The longer tube 35 extends into the housing, the larger this pool of liquid will be. The pool of liquid may comprise liquids accumulated from the system to allow for the settling of particulate matter and insoluble species that are not trapped by the porous absorbent material. Alternatively, the pool of liquid may comprise an additive to be dispensed into the combined fluids that enter the housing.

Where the pool of liquid is comprised of liquids which accumulated from the system, it will contain condensed working fluid and lubricating oil. The condensed working fluid can return to the VCCD when the compressor is turned off. At the same time, lubricating oil, preferably containing additives, returns to the VCCD by entrainment in the rapidly evaporating working fluid. However, impurities such as particulates, acid and sludge will be trapped in the absorbent filter material and will not return to the VCCD.

The extent to which tube 35 extends within the filter housing is a matter of design choice. For example, the embodiments depicted in FIGS. 1 and 2 do not provide for the extension of a tube into housing 5, although each depicted embodiment could readily be modified to provide for such a tube arrangement.

Figure 4:
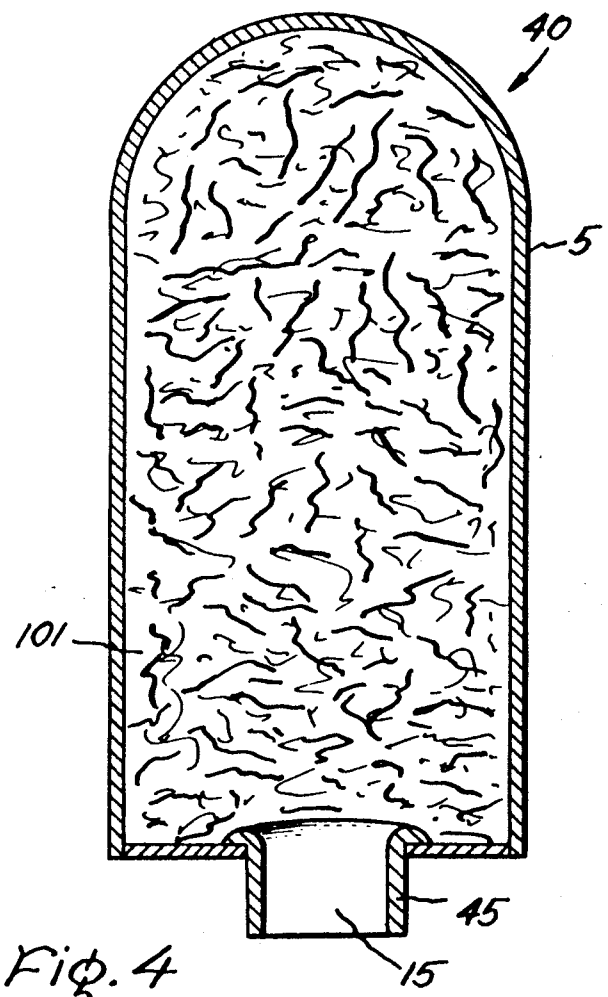

In the embodiments of FIGS. 1–3, the porous absorbent materials are similar in configuration. Only a portion of housing 5 is filled with porous absorbent material 10 in each embodiment. However, for some embodiments, it may be desirable to fill the housing completely with porous absorbent material, as shown in FIG. 4. In this embodiment, designated generally by reference numeral 40, porous absorbent material 101 completely fills housing 5. Tube 45 is inserted in orifice 15 as a connecting means to aid in the connection to a source of combined fluids from a VCCD.

The porous absorbent material can be configured in numerous ways to achieve its desired function. FIGS. 1–3 each illustrate a modified frustoconical configuration for the absorbent material having its base centrally positioned over orifice 15. Cavity 100 extends through the porous absorbent material from that portion of the base directly over the orifice to the top of the porous absorbent material. This configuration facilitates the transfer of fluid through cavity 100 to the end of housing 5 and causes liquids such as the lubricating oil and working fluid to pass through the absorbent material 10 while draining to orifice 15 and minimize that which flows back to orifice 15 via cavity 100.

Where it is desirable to dose additives (such as ZDDP) into the working fluid, the porous absorbent material can be configured to control the release of such additives by manipulating the duration of exposure of working fluids to the porous absorbent material. In addition, the size of the porous absorbent material, filter housing and the empty volume therein can be manipulated to control the quantity of working fluid that is treated with each operating cycle.

Figure 6:
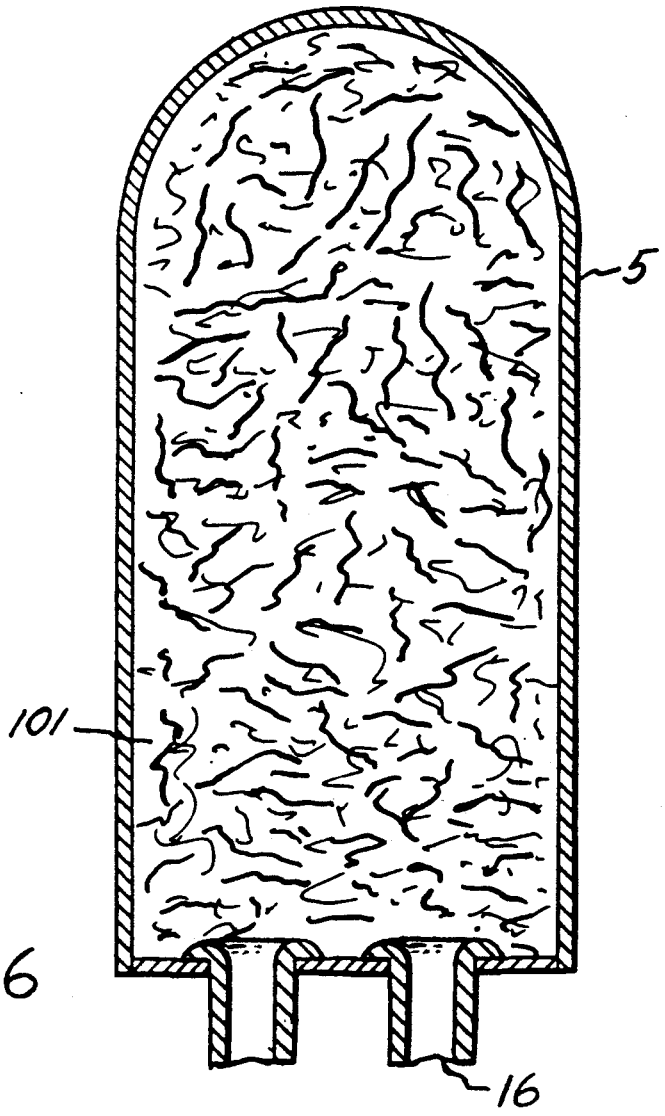
FIG. 6 is a schematic representation of an embodiment of the instant invention having two orifices.

Only one orifice is shown in the embodiments illustrated in FIGS. 1–4. However, as shown in FIG. 6, two or more orifices 16 can be provided to function simultaneously as outlets and inlets for the combined fluids. Such embodiments are considered a part of this invention.

Figure 5:
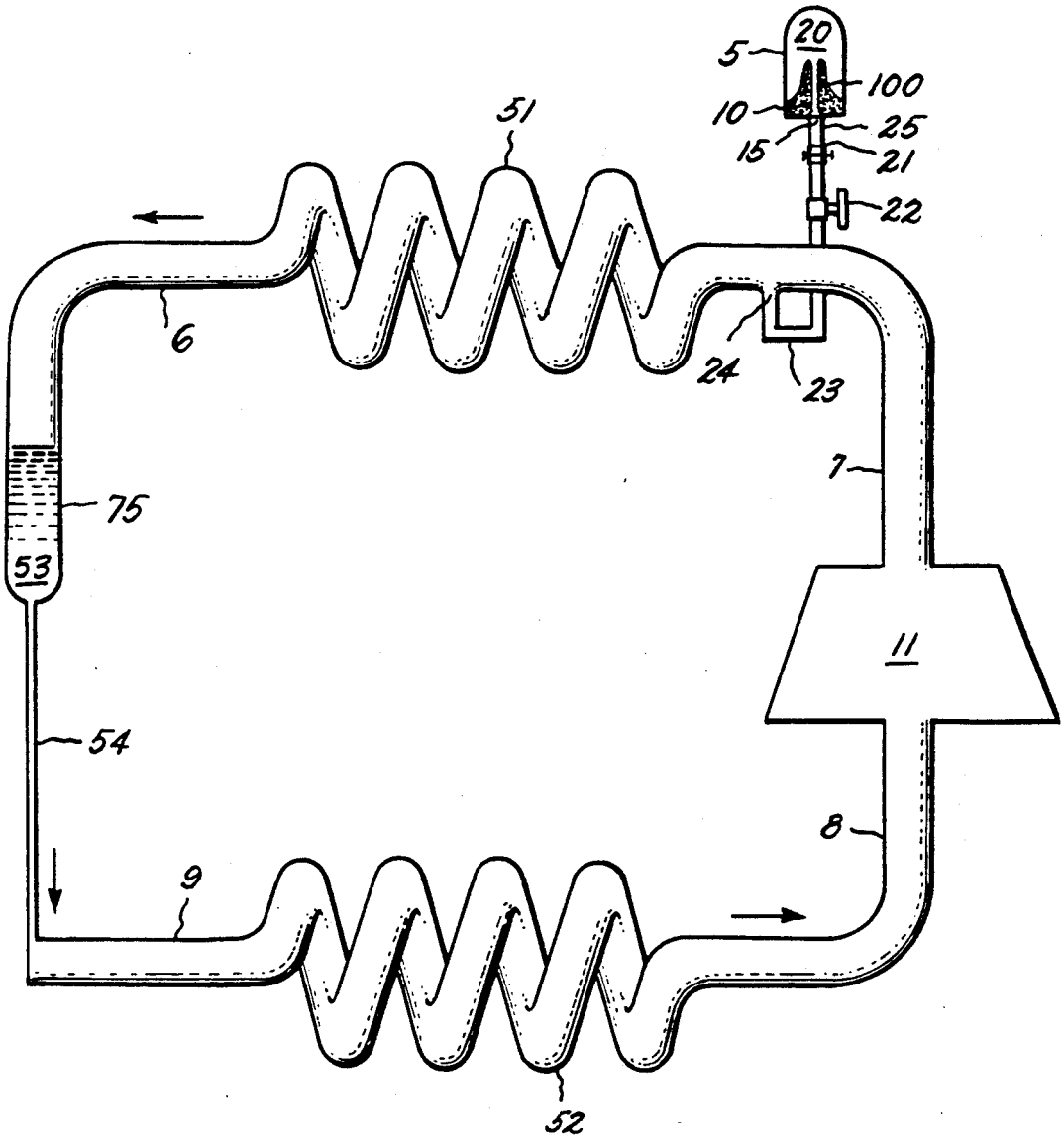
FIG. 5 is a schematic representation of a VCCD, which is also an embodiment of the invention.

With reference to FIG. 5, there is depicted a VCCD having positioned therein a filter in accordance with the present invention. The filter is positioned to receive combined fluids from the high pressure side of the VCCD. In addition to filter 20, the VCCD comprises a closed circuit for combined fluids which includes compressor 11, expansion device 54 and condenser 53 connected in series with a conduit for the transport of combined fluids. In the embodiment shown in FIG. 5, compressor 11, the condenser 53 and expansion device 54 are supplemented with heat exchangers 51 and 52, which are optional. All of the foregoing components are connected in a closed loop by conduits 6, 7, 8 and 9. Filter 20 is connected to the system via feed line 23 at outlet/inlet 24. Preferably, outlet/inlet 24 is at a low point in the system to allow oil to accumulate in feed line 23 during periods of low pressure. In FIG. 5, feed line 23 is shown with a shut-off valve 22 and receptacle 21 are optional components and may be replaced by a continuous feed line which terminates at inlet/outlet 24 and orifice 15. The filter shown in FIG. 1 would be suitable for such a configuration.

Filter 20 of FIG. 5 conforms to the embodiment shown in FIG. 2 wherein housing 5 retains porous absorbent material 10, which is of a modified frustoconical configuration. Tube 25 is positioned in orifice 15 and flared for connection to a receptacle in a feed line, such as receptacle 21 of FIG. 5.

In FIG. 5, filter 20 is connected via line 23 between compressor 11 and heat exchanger 51. The inlet/outlet 24 may be positioned downstream of heat exchanger 51 provided it is between condenser 53 and compressor 11. The embodiment shown in FIG. 5 is preferred in that the combined fluids are at high pressure and temperature at inlet/outlet 24 and condensation of the working fluid in the filter is facilitated. Inlet/outlet 24 may also be located on compressor 11 with a feed line for combined fluids sourced directed from the compressor.

While only one filter 20 is shown in FIG. 5, a plurality of filters may be used, each having a similar or specialized function in terms of removing impurities and dosing additives.

The present invention also provides a unique method for filtering the combined fluids within the VCCD by means of the cyclic on/off operation of the compressor. When compressor 11 is turned on, it compresses working fluid and discharges a high pressure gas/liquid mixture of superheated working fluid, such as a fluorocarbon in the Freon® series, having entrained therein small droplets of oil. A majority of the compressor discharge flows to the condenser 53 as an unmodified fluid, while a small fraction is withdrawn from the circuit and enters filter 20. The working fluid which enters housing 5 condenses to a liquid.

Housing 5 will continue to accept fluids until completely full or until the compressor turns off. The empty volume of the filter housing prescribes a predetermined maximum amount of combined fluids which can be withdrawn. Orifice 15 functions as an inlet for combined fluids during this period of increasing pressure within the housing. When housing 5 becomes filled with liquid, the remaining discharge will flow directly to the condenser 53, bypassing the filter.

When compressor 11 is turned off, the compressor no longer compresses working fluid and the high pressure side of the circuit decreases in pressure and the pressure within the housing decreases, allowing the combined fluids to pass through absorbent material 10, drain out of filter 20 through orifice 15, and return back to the circulating fluid within the vapor compression cycle device via conduit 23. Some or all of the working fluid may exit housing 5 as a vapor.

In such a system, there is no pressure drop within the closed circuit caused by the porous absorbent material as there is with in-line filters. In addition, while a plug or clog in an in-line filter could lead to a complete failure of the vapor compression cycle device, failure in the filter of the present invention produces no consequence to the device's operation in terms of its cooling capacity.

The method and apparatus of the present invention provide control of the quantity of combined fluids that is treated per cycle of the VCCD by controlling the empty volume within the housing. The size of the housing can vary widely since the filtration procedure is independent of the operation of the VCCD. By controlling the quantity of combined fluids treated, the dose of additives released into the combined fluids can also be controlled and tailored to the system's needs.

Furthermore, dosage of the beneficial additive is dependent upon the compressor operation, i.e., the needs of the system. With an in-line filter, the additive is continuously diffused into the combined fluids independent of the compressor operation. If the additive is continually dispensed, it is possible that an excessive quantity of additives can be introduced. This is most likely to occur where the unit is expected to be transported or stored for lengthy periods without operation.

The filters provided by the present invention can be installed in VCCD's presently in use. Since the filter does not detract from the cooling efficiency of the device, the filter need only be tapped into the existing lines of a VCCD, preferably between the compressor and the condenser at a low point in the system. In addition, the filter can be positioned at a location of easy access which may be remote from the existing compressor, condenser and feed lines within the VCCD. Replacement of the filter is also simplified in that the feed line to the filter can be shut off by a valve or other means without disturbing the operation of the VCCD. A new filter may then be connected to the feed line following closure of the shut off valve. The system need not be recharged with working fluid as with the replacement of some conventional in-line filters.

There are many classes of materials that are suitable for absorbing impurities within the combined fluids. Components suitable for use as the porous absorbent material in the present invention are numerous. The porous absorbent material may comprise a mixture of such components, e.g., of molecular sieves to extract moisture and alumina absorbents to filter particulates and desorb additives.

The components of the porous absorbent material may include crystalline zeolites, alumina and inert binders. Other components, such as activated charcoal, may also be used, provided they remain inert to the combined fluids and the additives therein.

Preferred components absorb acidic species and moisture and are sufficiently porous to filter a large volume of fluid while removing particulates. The components of the porous absorbent material are typically blended in the presence of water, compressed into the desired shape and fired (about 500° to 600° F.) to form a hard, porous core. Firing removes water absorbed by the components. This porous core may then be saturated with additives, if desired, to permit their desorption into the working fluid on operation.

Crystalline zeolites include a wide variety of hydrated metal aluminosilicates, both natural and synthetic, which possess a crystalline structure. The crystalline zeolites are desired for their absorptive properties, particularly towards moisture. Crystalline zeolite molecular sieves that are suitable for use as a component in the porous absorbent material include those hydrated metal aluminosilicates described in U.S. Pat. No. 3,025,233. One such crystalline zeolite is identified as Zeolite-X, having a pore size of about 8 to 10 Angstrom units. The synthesis of Zeolite-X is described in U.S. Pat. No. 2,882,244. Another synthesized crystalline zeolite is identified as Zeolite A in U.S. Pat. No. 3,025,233. Zeolite A is said to have a pore size ranging from about 3 to 5 Angstrom units. The synthesis of Zeolite A is described in U.S. Pat. No. 2,882,243. Suitable nature crystalline zeolite molecular sieves include those described in U.S. Pat. No. 3,025,233 such as mordenite and gmelinite, which have a pore size of about 3 to 4 Angstrom units, chabazite, erionite and analcite, which have a pore size of about 3 to 5 Angstrom units, and fauiasite, which has a pore size of about 8 to 11 Angstrom units.

In U.S. Pat. No. 3,025,233, Linde Air Products Company is identified as a source of crystalline zeolite molecular sieves such as hydrated crystalline sodium and calcium aluminosilicates.

Partially dehydrated aluminum hydroxide gel or activated alumina gel has high absorption capacity also, although less than that of the crystalline zeolites, and is suitable for use as a component in the porous absorbent material. In U.S. Pat. No. 3,025,233, activated alumina gel is said to be produced by spray drying aluminum hydroxide gel, forming spherical aluminum gel balls from the dry gel, and activating the spherical gel powder at elevated temperatures to remove the combined water. U.S. Pat. No. 3,025,233 identifies the Aluminum Company of America (ALCOA) as being a source of activated alumina balls having a diameter of about $\frac{1}{8}$ inch.

Activated and calcined species of alumina are preferred components for the porous absorbent material, since they also filter insoluble species and particulates, remove acids and desorb additives such as ZDDP into the working fluid. Such alumina may be formed from either hydrated alumina or saturated alumina during the firing of the shaped blend. U.S. Pat. No. 3,025,233 identified a commercially available hydrated alumina from ALCOA that is designated C-40.

Inorganic or organic binders may be used to bind the components of the porous absorbent material. Suitable organic binders include phenol-formaldehyde, melamine-formaldehyde and epoxide resins. Suitable inorganic binders include aluminum phosphate binders and sodium silicate binders.

Activated charcoal may also form part of the porous absorbent material so as to remove wax that is formed in the system, as disclosed in U.S. Pat. No. 3,407,761.

The components of the porous absorbent material may be used in any combination provided they remain inert. However, the preferred component is activated alumina, which permits the absorption and desorption of zinc dialkyldithiophosphate.

The present invention has been illustrated by reference to particular embodiments, such as those represented in the drawings. It is not intended to limit the present invention to these particular embodiments, rather it is to be understood that ths disclosure is intended to be illustrative and not limiting. Further modifications are possible in light of the above teachings and will readily occur to one skilled in the art without departing from the spirit of the invention and the scope of the appended claims.

What is claimed is:

1. A filter for combined fluids comprising working fluid and lubricating oil within a vapor compression cycle device having a high pressure side and a low pressure side, said filter comprising a housing having disposed therein a porous absorbent material capable of separating and trapping impurities from said combined fluids which flow therethrough, wherein said housing is provided with an orifice means to function as both an inlet and an outlet for said combined fluids transferred in and out of said housing, wherein said housing is additionally constructed to accept connection with a means for transferring said combined fluids to said orifice from the high pressure side of a vapor compression cycle device, wherein said housing is provided with volume to accept condensed working fluid and said lubricating oil during periods of increasing pressure in said device and, wherein said porous absorbent material contains at least one absorbed additive in sufficient quantity to release said additive into said combined fluid which passes therethrough.

2. A filter as in claim 1 wherein the housing orifice is positioned in the housing so as to function as an inlet for vaporized working fluid having said lubricating oil entrained therein during periods of increasing pressure and as an outlet for said vaporized working fluid having said lubricating oil entrained therein during periods of decreasing pressure.

3. A filter as in claim 2 having more than one orifice operable as an inlet for the combined fluids during periods of increasing pressure and as an outlet for combined fluids during periods of decreasing pressure.

4. A filter as in claim 1 wherein the porous absorbent material is capable of separating one or more impurities from the combined fluids which flow therethrough, the impurities being selected from the group consisting of acidic species, moisture, particulates and oil insoluble species.

5. A filter as in claim 4 wherein the porous absorbent material is comprised of one or more porous materials selected from the group consisting of crystalline zeolites, alumina and activated charcoal.

6. A filter as in claim 4 wherein the porous absorbent material is comprised of activated alumina with absorbed zinc dialkyldithiophosphate in sufficient quantity to dispense zinc dialkyldithiophosphate to the combined fluids which pass therethrough.

7. A filter as in claim 1 wherein the housing is adapted to accept connection with a means for transferring combined fluids to said orifice from a location between the compressor and condenser of a vapor compression cycle device.

8. A filter as in claim 1 wherein the housing is substantially filled with porous absorbent material.

9. A filter as in claim 1 where the housing is partially filled with porous absorbent material.

10. A filter as in claim 9 wherein the porous absorbent material is of a modified frustoconical configuration having its base centrally positioned over the orifice and wherein a cavity extends through said porous absorbent material from that portion of said base directly over the orifice to the top of said porous absorbent material such that impurities not trapped by said porous absorbent material are accumulated at the bottom of said housing.

11. A filter as in claim 1 further comprising means for connecting said housing at the orifice to the high pressure side of a vapor compression cycle device.

12. A filter as in claim 11 wherein the housing means provides for removable connection of said housing with a vapor compression cycle device.

13. A filter as in claim 12 wherein the connecting means comprises a tube affixed to the housing at the orifice and a free end capable of accepting connection with a conduit which transfers combined fluids from the high pressure side of a vapor compression cycle device.

14. A filter as in claim 13 wherein the tube extends through the orifice and terminates within said housing so as to cause said combined fluids having said impurities therein to pass through said porous absorbent material before draining through said orifice.

15. A filter as in claim 11 wherein the orifice and connecting means are positioned to provide for a pool of liquid within said housing.

16. A filter as in claim 1 wherein the outlet is located at the lowest portion of the housing.

17. A filter as in claim 1 wherein the housing defines a cavity of a size adapted to fill completely with liquid during the operation of a compressor in a vapor compression cycle device, once connected thereto.

18. A filter for filtering fluorocarbon refrigerant within a refrigerator comprising a housing having only one orifice for the transfer of said fluorocarbon refrigerant in and out of said housing, a porous absorbent material being disposed within said housing for separating impurities and wherein said porous absorbent material contains an absorbed additive in sufficient quantity to release said additive into the fluorocarbon refrigerant which passes therethrough and a means for connecting said housing to a conduit which transfers said fluorocarbon refrigerant to said orifice from a location between a compressor and a condenser of the refrigerator.

19. A vapor compression cycle device comprising a closed circuit for combined fluids comprising a working fluid and lubricating oil, a means for filtering said combined fluids and a means for dispensing at least one additive into said combined fluids, said closed circuit comprising a compressor, a condenser and an expansion device connected in series with conduit for the cyclic transport of said combined fluids, said means for filtering the working fluids comprising a filter and a conduit, said filter comprising a housing capable of condensing working fluid during periods of increasing pressure in said device, said housing having disposed therein a porous absorbent material containing at least one absorbed additive in sufficient quantity to release said additive into said combined fluids which pass therethrough, said housing having one orifice for the transfer of said combined fluids into and out of said housing, and said conduit being capable of transporting said combined fluids, having one end connected to the housing at the orifice and the other end connected to the closed circuit at a position between the compressor and the condenser of said closed circuit.

20. A vapor compression cycle device as in claim 19 wherein the absorbent material comprises activated alumina which contains absorbed zinc dialkyldithiophosphate in sufficient quantity to release zinc dialkyldithiophosphate to the combined fluids which pass therethrough.

21. A vapor compression cycle device as in claim 19 further comprising a fluorocarbon working fluid charged therein.

22. A vapor compression cycle device as in claim 19 wherein the housing is removably connected to the conduit.

23. A vapor compression cycle device as in claim 19 wherein said housing defines a cavity having a volume which is selected to substantially fill during operation of the compressor.

24. A vapor compression cycle device as in claim 19 further comprising a shut-off valve positioned between the closed circuit for combined fluids and said housing.

25. A vapor compression cycle device as in claim 19 wherein the porous absorbent material within said housing is of a modified frustoconical configuration with its base positioned over said orifice, said porous absorbent material having a cavity positioned over the orifice extending from the base to the top of said porous absorbent material.

26. A vapor compression cycle device as in claim 19 wherein the porous absorbent material is capable of separating one or more impurities from the combined fluids which flow therethrough, the impurities being selected from the group consisting of acidic species, moisture, particulates and oil insoluble species.

27. A vapor compression cycle device as in claim 26 wherein the porous absorbent material is comprised of one or more porous materials selected from the group consisting of crystalline zeolites, alumina and activated charcoal.

28. A vapor compression cycle device as in claim 19 wherein the orifice in said housing is operable as an inlet for combined fluids during periods of increasing pressure and as an outlet for combined fluids during periods of decreasing pressure.

29. A dispensing filter for combined fluids comprising working fluid and lubricating oil within a vapor compression cycle device having a high pressure side and a low pressure side, said filter comprising a housing having disposed therein a porous absorbent material capable of separating impurities from said combined fluids which flow therethrough, said porous absorbent material further contains at least one or more absorbed additives in sufficient quantity to release said additives into said combined fluids, wherein said housing is provided with an orifice means to function as both an inlet and an outlet for said combined fluids transferred in and out of said housing, wherein said housing is further provided with connection with a feed line from said high pressure side of said device for transferring said combined fluids to said housing and, wherein said housing is provided with volume to accept condensed working fluid and said lubricating oil during periods of increasing pressure in said device.

30. The filter of claim 29 wherein said feed line is further provided with a low point to allow said lubricating oil to accumulate therein during periods of low pressure.

* * * * *